US010985501B2

(12) United States Patent
Akagi

(10) Patent No.: US 10,985,501 B2
(45) Date of Patent: Apr. 20, 2021

(54) LEVER-TYPE CONNECTOR

(71) Applicant: Yazaki Corporation, Tokyo (JP)

(72) Inventor: Yosuke Akagi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/812,601

(22) Filed: Mar. 9, 2020

(65) Prior Publication Data

US 2020/0295508 A1 Sep. 17, 2020

(30) Foreign Application Priority Data

Mar. 15, 2019 (JP) ..... JP2019-048501

(51) Int. Cl.
*H01R 13/629* (2006.01)

(52) U.S. Cl.
CPC . *H01R 13/62955* (2013.01); *H01R 13/62938* (2013.01)

(58) Field of Classification Search
CPC ..... H01R 13/62955; H01R 13/62938; H01R 13/6295; H01R 13/641
USPC ..... 439/372, 157
See application file for complete search history.

(56) References Cited

U.S. PATENT DOCUMENTS 5,476,390 A * 12/1995 Taguchi ..... H01R 13/62938 439/155
5,876,225 A 3/1999 Katsuma et al.
6,767,231 B1 * 7/2004 Martin ..... H01R 13/62944 439/157
7,416,425 B2 * 8/2008 Murakami ..... H01R 13/6295 439/157
9,716,341 B2 * 7/2017 Yamane ..... H01R 13/703

FOREIGN PATENT DOCUMENTS

JP 09-223539 A 8/1997

* cited by examiner

*Primary Examiner* — Hien D Vu
(74) *Attorney, Agent, or Firm* — Sughrue Mion, PLLC

(57) ABSTRACT

The lever-type connector includes a first housing, a housing fitted to and removed from the first housing, and a lever turnably supported by the housing, where the lever is configured to fit the both housings. The lever includes a provisional lock arm portion having a provisional locking portion, and the housing includes a provisional locked portion configured to be provisionally fitted to and detached from the provisional locking portion of the provisional lock arm portion and a provisional set arm portion configured to suppress detachment between the first housing and the housing in the provisionally set state during the provisional lock release of the lever. The first housing includes a release rib portion configured to release the provisional locking state between the provisional locking portion of the provisional lock arm portion and the provisional locked portion of the housing.

4 Claims, 9 Drawing Sheets

LEVER-TYPE CONNECTOR

BACKGROUND

Technical Field

The present disclosure relates to a lever-type connector that can perform connector fitting with a low insertion force by turning a lever.

Related Art

This lever-type connector includes a housing having a hood portion that is fitted to and removed from the mating housing (JP 9-223539 A). This lever-type connector includes a cam groove whose both mounting portions are turnably supported by support shafts on both sides of the housing, and that engages with a cam pin provided in the mating housing, and a lever configured to fit the both housings by engagement between the cam groove and the cam pin by performing a turning operation from the initial position (provisional set position) to the fitting completion position. On both the mounting portions of the lever, locking projections for performing turning restriction on the lever are provided at a position deviating from the locus of introduction of the cam pin into the cam groove.

When the cam pin is introduced into the cam groove at the beginning of the fitting of both housings, the pressed portions provided on both sides of the mating housing engage with the locking projections of the lever, and are displaced to the outside and removed from the engagement groove provided in the hood portion. Therefore, the turning restriction on the lever is canceled. Unlike the case where the turning restriction is canceled by the cam pin, the locking projection is not displaced so as to cross the cam groove, and therefore the amount of bending of the locking projection can be suppressed to a small value.

SUMMARY

However, since the conventional lever-type connector has a structure that suppresses the amount of displacement when the provisional set lock of the lever is released, there is no holding force between the housing and the mating housing in the provisionally set state, and there is a possibility that both housings may be easily detached before the lever is turned.

Therefore, an object of the present disclosure is to provide a lever-type connector that can prevent the detachment of both housings in a provisionally set state before a turning operation of the lever in the provisional locking state.

The present disclosure provide a lever-type connector including:

a first housing having a cam boss;

a second housing fitted to and removed from the first housing; and a lever turnably supported by the second housing via a support shaft, the lever having a cam groove engaging with the cam boss, the lever configured to pull the first housing toward the second housing to fit the first housing and the second housing by engagement between the cam groove and the cam boss through a turning operation from a provisional locking position to a fitting completion position, wherein the lever includes a provisional lock arm portion having a provisional locking portion, the provisional lock arm portion being elastically deformed, the second housing includes a provisional locked portion configured to be provisionally locked to and detached from the provisional locking portion of the provisional lock arm portion and a provisional set arm portion configured to suppress detachment between the first housing and the second housing in a provisionally set state during a provisional lock release between the provisional locking portion of the provisional lock arm portion and the provisional locked portion of the second housing, and the first housing includes a release rib portion configured to release a provisional locking state between the provisional locking portion of the provisional lock arm portion and the provisional locked portion of the second housing.

According to this disclosure, by the provisional set arm portion provided in the second housing, it is possible to suppress detachment between the first housing and the second housing in the provisionally set state before the lever in the provisional locking state is turned.

DETAILED DESCRIPTION

Hereinafter, an embodiment of the present disclosure will be described with reference to the accompanying drawings.

Figure 1:
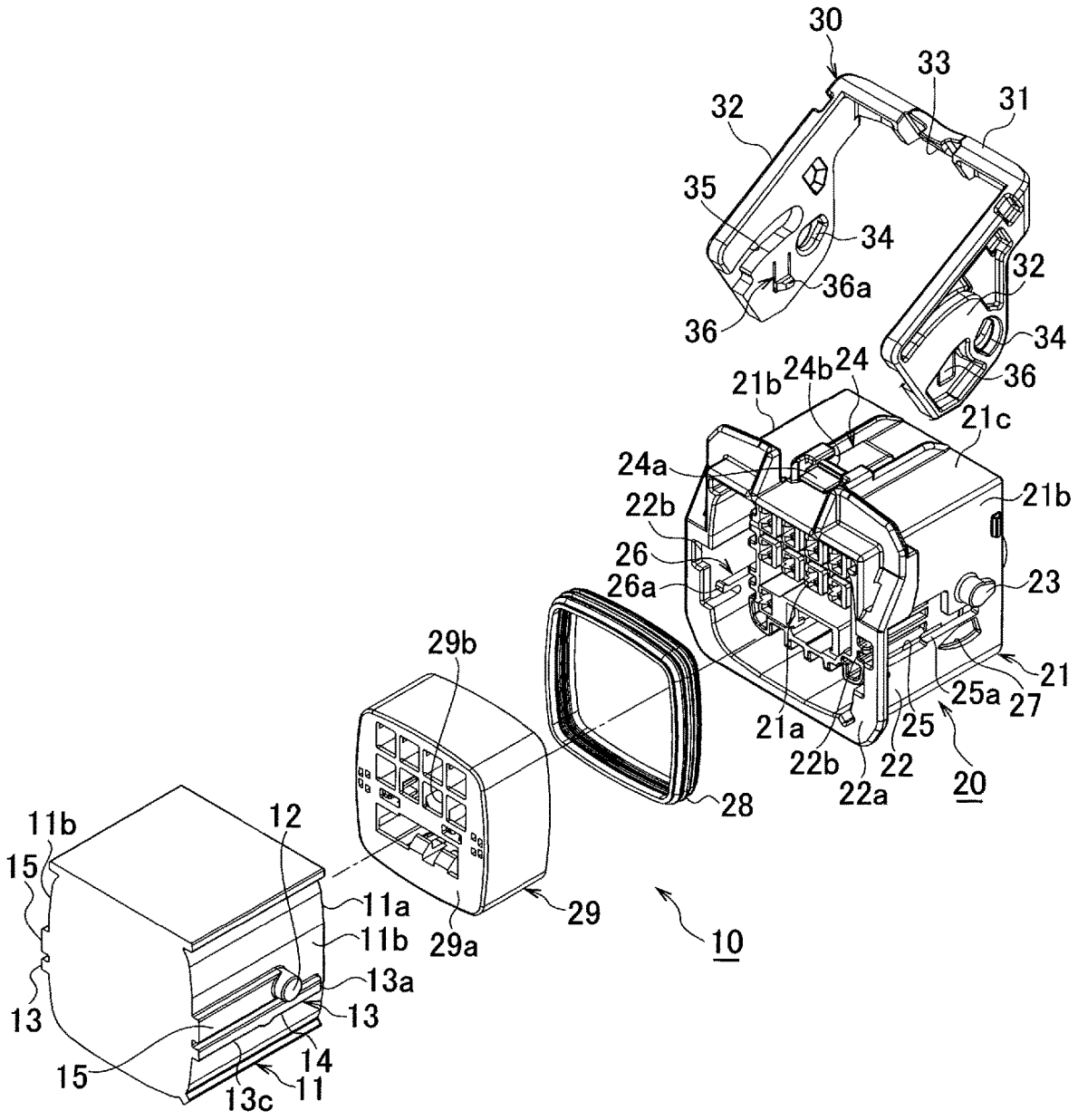
FIG. 1 is an exploded perspective view of a lever-type connector according to an embodiment of the present disclosure.

As illustrated in FIG. 1, a lever-type connector 10 includes a synthetic resin male housing (first housing) 11 having a cam boss 12, a synthetic resin female housing (second housing) 20 that is fitted to and removed from the male housing 11, a cam groove 35 that is turnably supported via a support shaft 23 provided in the female housing 20, and that engages with the cam boss 12 of the male housing 11, and a synthetic resin lever 30 for fitting the male and female housings 11 and 20 by pulling the male housing 11 toward the female housing 20 by engagement between the cam groove 35 and the cam boss 12 by turning an operation portion 31.

Figure 2:
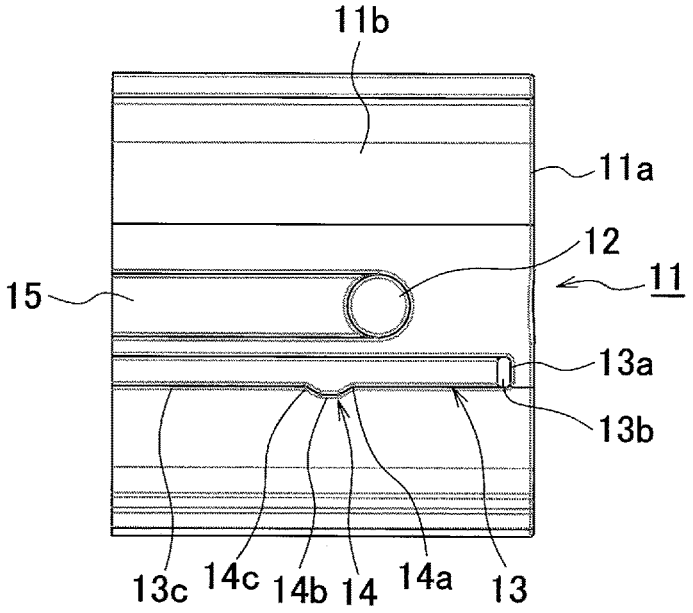
FIG. 2 is a side view of the male housing of the lever-type connector.

As illustrated in FIGS. 1 and 2, the male housing 11 has a hood portion 11*a* inserted into a hood portion 22 of the female housing 20 on the front side. In addition, the cylindrical cam boss 12 is integrally projected at the center of each of both side faces 11*b* and 11*b* of the male housing 11. Furthermore, a release rib portion 13 extending in the front-rear direction is integrally projected below the cam boss 12 on both side faces 11*b* and 11*b* of the male housing 11. The distal end 13*a* of the release rib portion 13 is a release portion configured to release the provisional locking state between a cutout portion (provisional locked portion) 25 of the female housing 20 and a provisional locking protrusion (provisional locking portion) 36*a* of a provisional lock arm portion 36 of the lever 30 described later. Further, a trapezoidal provisional set beak portion 14 is integrally projected at the center of the lower face 13*c* of the release rib portion 13. As illustrated in FIG. 2, a slope 13*b* is provided on the rear side of the distal end 13*a* of the release rib portion 13. The trapezoidal provisional set beak portion 14 has a front slope 14*a*, a straight face 14*b*, and a rear slope 14*c*. Further, as illustrated in FIG. 5, a tab portion 16*a* of a male terminal (terminal) 16 is exposed in the hood portion 11*a* of the male housing 11.

Figure 3:
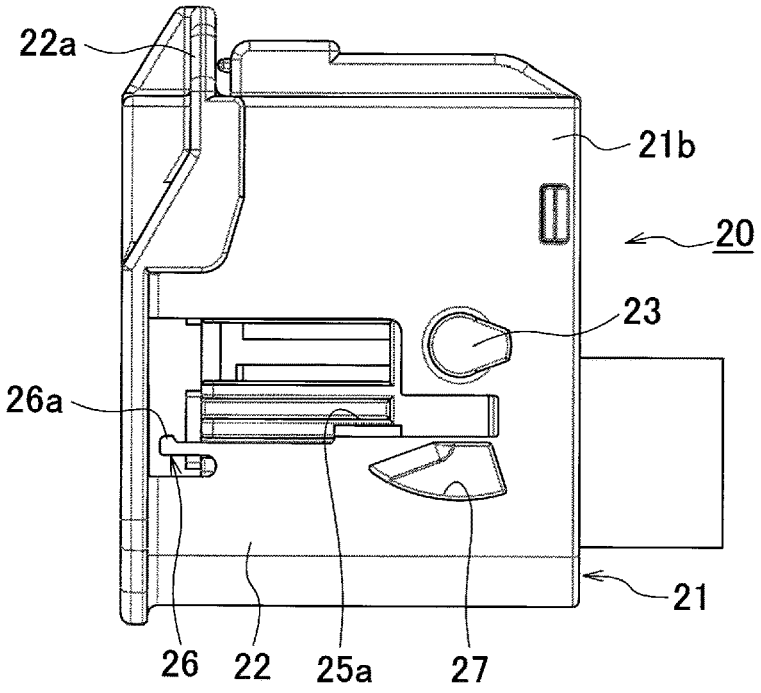
FIG. 3 is a side view of the female housing of the lever-type connector.
Figure 5:
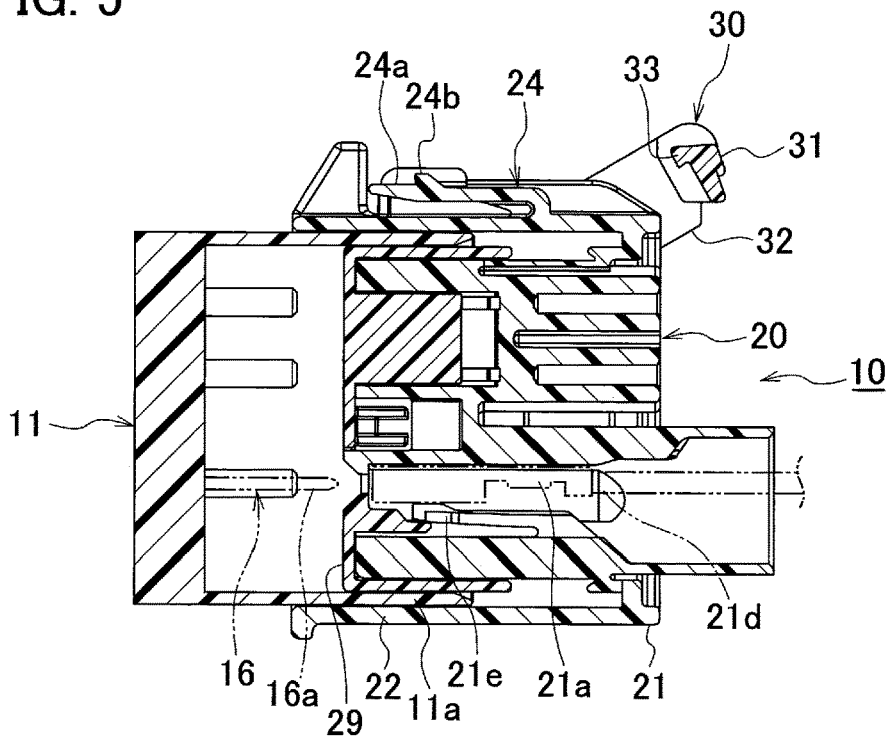
FIG. 5 is a cross-sectional view taken along line X-X in FIG. 4 at the start of insertion of the provisional set arm portion of the female housing.

As illustrated in FIG. 1, FIG. 3, and FIG. 5, the female housing 20 includes a block-shaped housing body 21 having a plurality of terminal accommodating chambers 21*a*, and a hood portion 22 that is integrally projected on the front side of the housing body 21, and into which the hood portion 11*a* of the male housing 11 is fitted. The support shaft 23 is integrally projected at the center of each of both side faces 21*b* and 21*b* of the housing body 21. Further, an elastically deformable lock arm portion 24 is integrally projected on the front side of the center of the upper face 21*c* of the housing body 21. A reception portion 24*b* is integrally projected at the free end (distal end) 24*a* of the lock arm portion 24.

As illustrated in FIGS. 1 and 3, a substantially rectangular cutout portion (provisional locked portion) 25 is formed on the front side of the center of each of both sides of the hood portion 22 of the female housing 20. That is, a provisional locking protrusion 36*a* of the provisional lock arm portion 36 of the lever 30 described later is provisionally locked to and detached from the lower edge 25*a* of each cutout portion 25, and when the provisional locking protrusion 36*a* of the provisional lock arm portion 36 is provisionally locked to the lower edge 25*a*, as illustrated in FIG. 6, the lever 30 is held in the provisional locking position (provisional locking state).

Figure 14A:
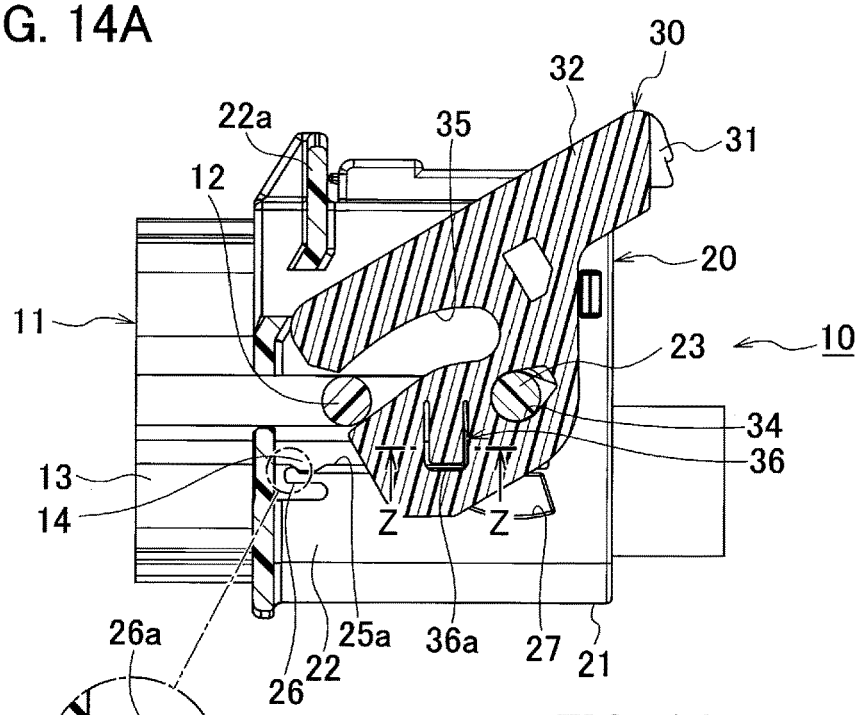
FIG. 14A is a cross-sectional view taken along line Y-Y in FIG. 4 at the time of displacement completion of the provisional set arm portion while the provisional lock arm portion is being provisionally lock released.
Figure 14A:
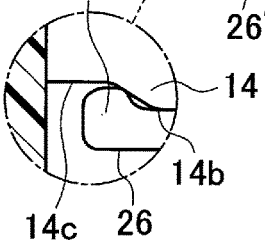
Figure 14B:
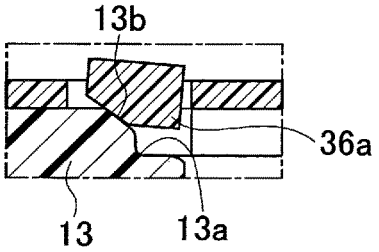
FIG. 14B is a cross-sectional view taken along line Z-Z in FIG. 14A.

Also, as illustrated in FIGS. 1 and 3, a provisional set arm portion 26 is elastically deformably integrally formed on the front side of the lower edge 25*a* of each cutout portion 25. The provisional set arm portion 26 has a protrusion portion 26*a* configured to slide along the lower face 13*c* of the release rib portion 13 at the distal end (free end) of the provisional set arm portion 26. Until this protrusion portion 26*a* slides along the lower face 13*c* of the release rib portion 13, and the protrusion portion 26*a* goes over the provisional set beak portion 14 from the lower face 13*c* of the release rib portion 13 as illustrated in FIGS. 14A and 14B, the provisional set arm portion 26 suppresses detachment between the male housing 11 and the female housing 20 in the provisionally set state while the lever 30 is provisionally lock released.

In addition, as illustrated in FIG. 1, a square annular packing 28 made of rubber is interposed between the hood portion 22 and a plurality of terminal accommodating chambers 21*a* of the housing body 21 of the female housing 20. Furthermore, as illustrated in FIG. 5, a front holder 29 made of a synthetic resin having a square cylindrical shape having a front wall portion 29*a* is fitted into the periphery of the plurality of terminal accommodating chambers 21*a* of the housing body 21 in the hood portion 22 of the female housing 20. The front wall portion 29*a* of the front holder 29 is provided with a plurality of rectangular openings 29*b* communicating with the plurality of terminal accommodating chambers 21*a* of the housing body 21. As illustrated in FIG. 5, a female terminal 21*d* accommodated in each of the terminal accommodating chamber 21*a* of the housing body 21 is locked by a lance 21*e*.

Figure 6:
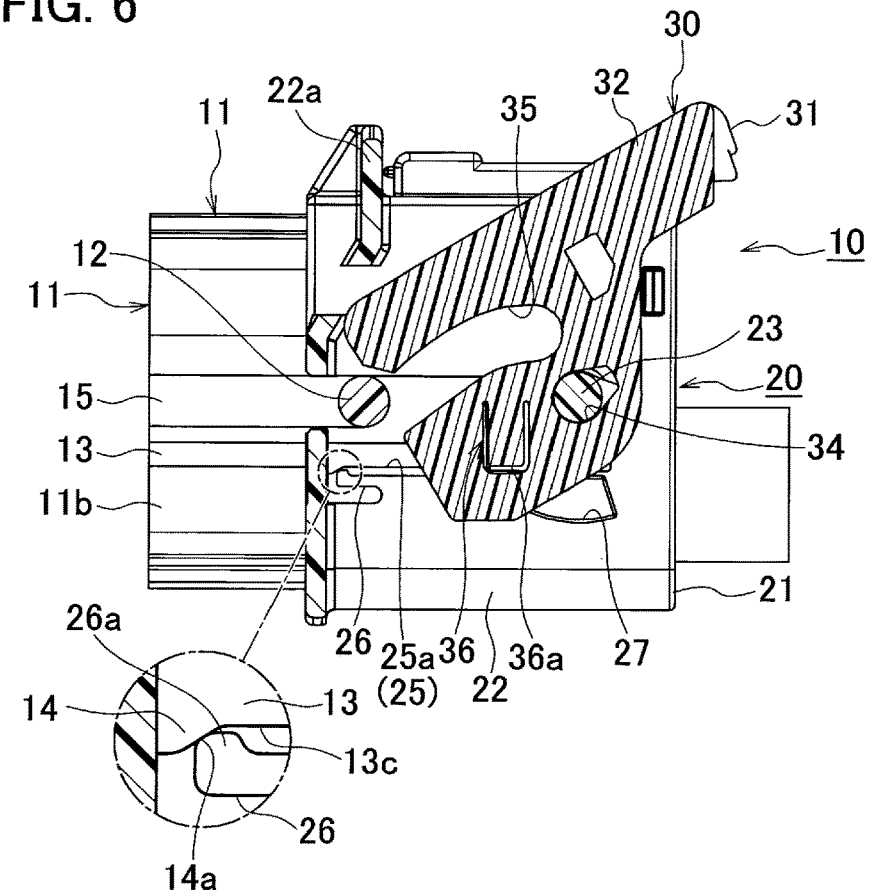
FIG. 6 is a cross-sectional view taken along line Y-Y in FIG. 4 at the start of insertion of the provisional set arm portion.

As illustrated in FIGS. 1 and 6, the lever 30 includes the operation portion 31 and a pair of arm portions 32 and 32 extending from both sides of the operation portion 31.

As illustrated in FIGS. 1 and 5, a locking protrusion 33 is provided on the lower side of the center of the operation portion 31 of the lever 30. The locking protrusion 33 is locked to the reception portion 24*b* of the lock arm portion 24 of the female housing 20 when the lever 30 is turned to the turning completion position. Due to this locking, the turning restriction state occurs in which the turning of the lever 30 is restricted. The locking state between the locking protrusion 33 of the lever 30 and the reception portion 24*b* of the lock arm portion 24 of the female housing 20 is released when the reception portion 24*b* of the lock arm portion 24 is detached from the locking protrusion 33 by pressing the free end 24*a* of the lock arm portion 24 downward.

Figure 16A:
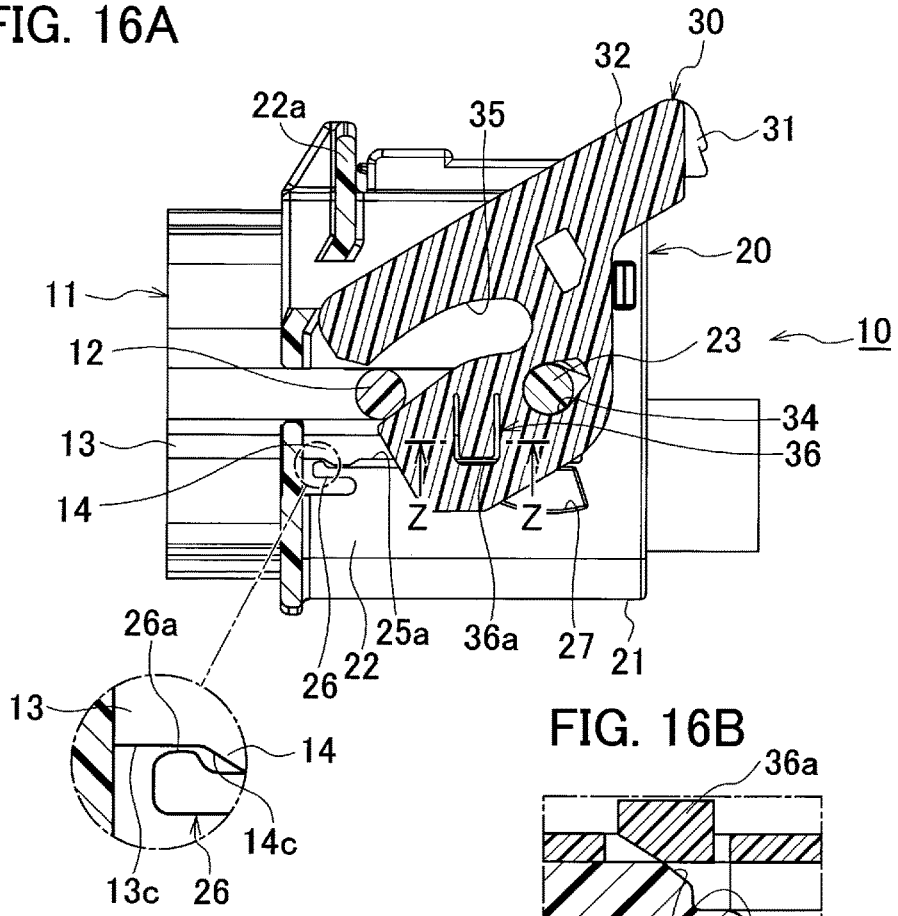
FIG. 16A is a cross-sectional view taken along line Y-Y in FIG. 4 when the provisional lock arm portion has been provisionally lock released.
Figure 16B:
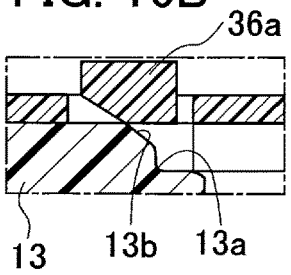
FIG. 16B is a cross-sectional view taken along line Z-Z in FIG. 16A.

As illustrated in FIG. 1, a bearing hole 34 that is turnably supported by the support shaft 23 is formed on the rear side of the center of each arm portion 32 of the lever 30. An arc concave cam groove 35 is formed inside each arm portion 32. Further, the elastically deformable provisional lock arm portion 36 having the provisional locking protrusion (provisional locking portion) 36*a* at its distal end is integrally formed below each arm portion 32. As illustrated in FIGS. 16A and 16B, immediately after the provisional locking state between the provisional locking protrusion 36*a* of the provisional lock arm portion 36 of the lever 30 and the lower edge 25*a* of the cutout portion 25 of the female housing 20 is released at the distal end 13*a* of the release rib portion 13 of the male housing 11 (after the provisional locking state is released, or at the same time when the provisional locking state is released), the protrusion portion 26*a* of the provisional set arm portion 26 of the female housing 20 goes over the provisional set beak portion 14 of the release rib portion 13 of the male housing 11.

Figure 4:
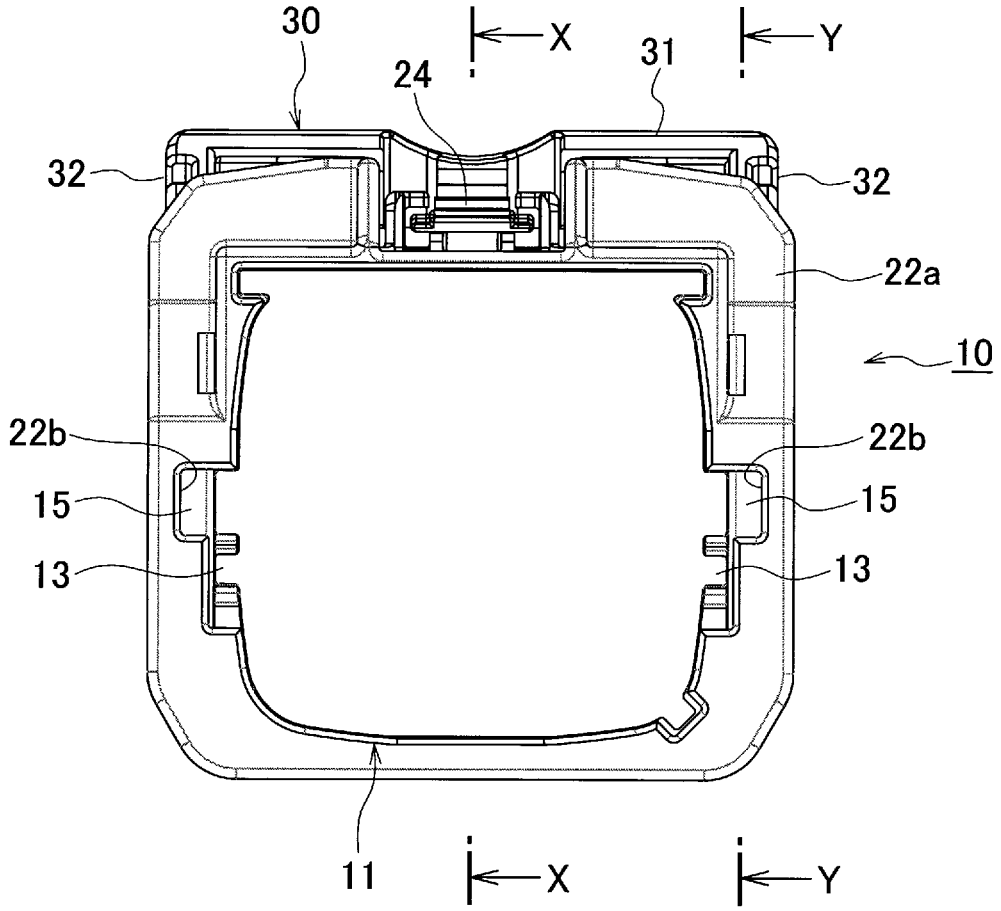
FIG. 4 is a front view of the lever-type connector.

As illustrated in FIGS. 1 and 4, a projection portion 15 is integrally projected in parallel with the release rib portion 13 rearward of the cam boss 12 on each of both side faces 11*b* and 11*b* of the male housing 11. As illustrated in FIG. 4, when the male housing 11 is inserted into the hood portion 22 of the female housing 20, the projection portion 15 of the male housing 11 is accommodated and guided in the recess portions 22*b* formed on both sides of a flange portion 22*a* of the hood portion 22 of the female housing 20. Also, when the lever 30 is turned from the provisional locking position to the turning completion position, and the locking protrusion 33 of the lever 30 is locked to the reception portion 24*b* of the lock arm portion 24 of the female housing 20 and is held in the turning restriction state, the provisional locking protrusion 36*a* of the provisional lock arm portion 36 provided on the arm portion 32 of the lever 30 is moved and accommodated in from the lower edge 25*a* of the cutout portion 25 on both sides of the hood portion 22 of the female housing 20 to a hole 27 formed on the lower side of the cutout portion 25.

Next, the process until the provisional locking state between the provisional locking protrusion 36*a* of the provisional lock arm portion 36 of the lever 30 and the lower edge 25*a* of the cutout portion 25 of the female housing 20 is released at the distal end 13*a* of the release rib portion 13 of the male housing 11, and the protrusion portion 26*a* of the provisional set arm portion 26 of the female housing 20 goes over the provisional set beak portion 14 of the release rib portion 13 of the male housing 11 will be described in order with reference to FIGS. 5 to 16B.

As illustrated in FIG. 5 and FIG. 6, at the start of insertion of the provisional set arm portion 26 of the female housing 20 when inserting the hood portion 11*a* of the male housing 11 into the hood portion 22 of the female housing 20, the provisional locking protrusion 36*a* of the provisional lock arm portion 36 of the lever 30 is provisionally locked to the lower edge 25*a* of the cutout portion 25 of the female housing 20, and the protrusion portion 26*a* of the provisional set arm portion 26 of the female housing 20 is in contact with the front slope 14*a* of the provisional set beak portion 14 of the male housing 11. This state is a provisionally set state of the male housing 11 and the female housing 20. The protrusion portion 26*a* of the provisional set arm portion 26 comes into contact with the front slope 14*a* of the provisional set beak portion 14, and the provisional set arm portion 26 is bent and deformed downward (elastic deformation), so that this provisionally set state is held by the reaction force. That is, the male housing 11 and the female housing 20 in the provisionally set state are held by the reaction force due to the elastic deformation of the provisional set arm portion 26, and the holding force is significantly improved compared to the conventional one.

Figure 7:
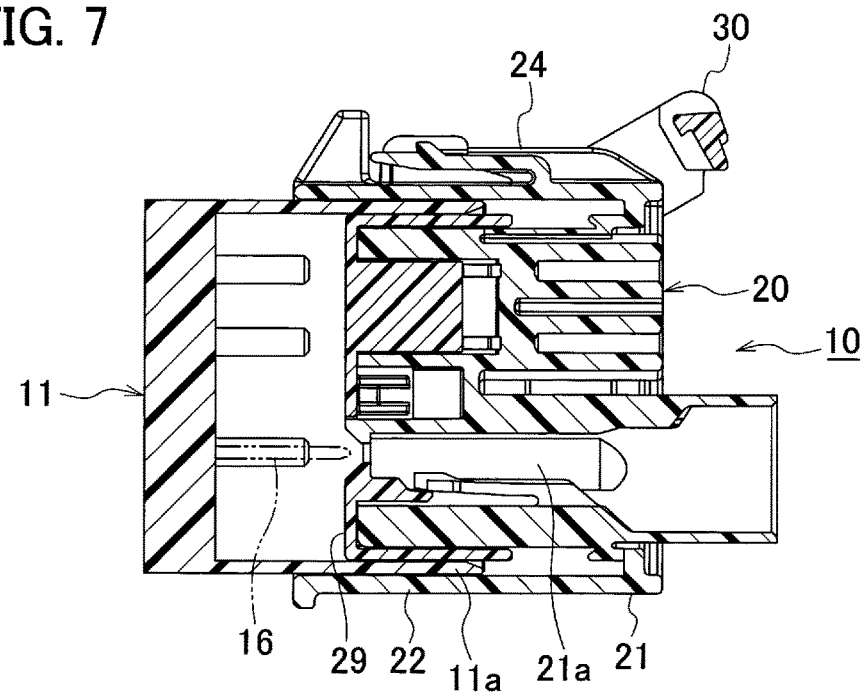
FIG. 7 is a cross-sectional view taken along line X-X in FIG. 4 at the insertion peak of the provisional set arm portion.
Figure 8:
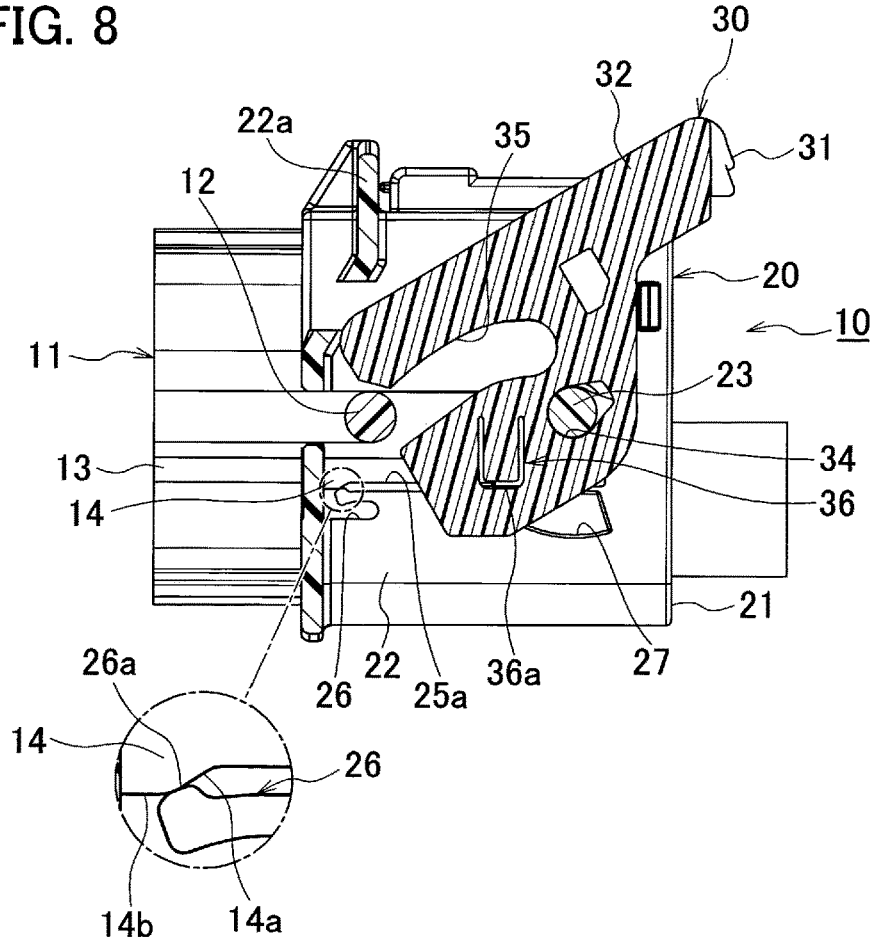
FIG. 8 is a cross-sectional view taken along line Y-Y in FIG. 4 at the insertion peak of the provisional set arm portion.

As illustrated in FIG. 7 and FIG. 8, at the peak of insertion of the provisional set arm portion 26 of the female housing 20, the provisional locking protrusion 36*a* of the provisional lock arm portion 36 of the lever 30 is provisionally locked to the lower edge 25*a* of the cutout portion 25 of the female housing 20, and the protrusion portion 26*a* of the provisional set arm portion 26 of the female housing 20 goes on a straight slope 14*b* from the front slope 14*a* of the provisional set beak portion 14 of the male housing 11 due to elastic deformation (displacement) of the provisional set arm portion 26.

Figure 9:
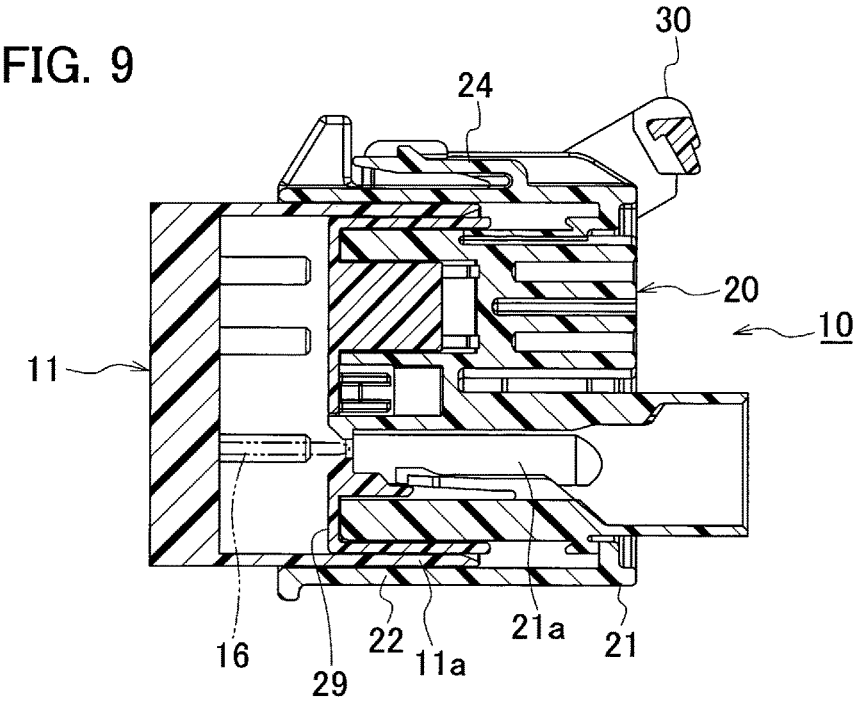
FIG. 9 is a cross-sectional view taken along line X-X in FIG. 4 during displacement of the provisional set arm portion at the start of provisional lock release of the provisional lock arm portion of the lever of the lever-type connector.
Figure 10A:
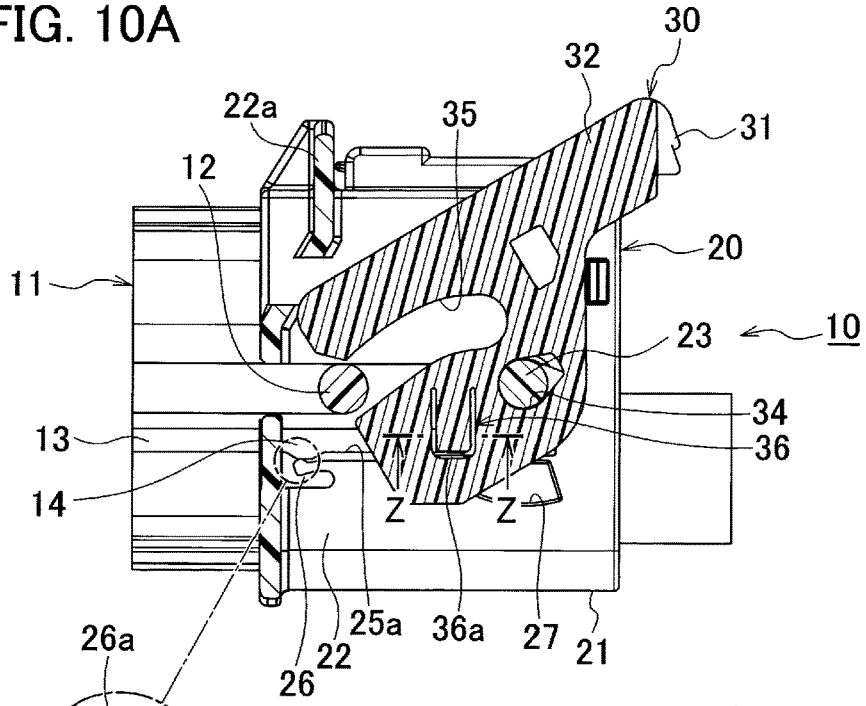
FIG. 10A is a cross-sectional view taken along line Y-Y in FIG. 4 during displacement of the provisional set arm portion at the start of provisional lock release of the provisional lock arm portion.
Figure 10A:
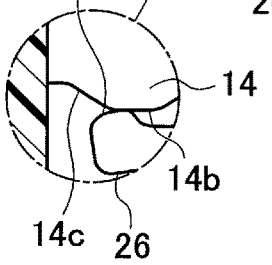
Figure 10B:
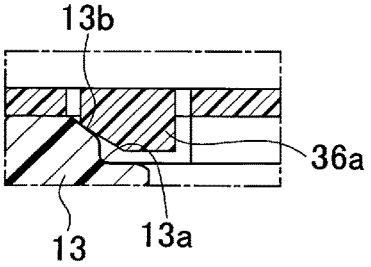
FIG. 10B is a cross-sectional view taken along line Z-Z in FIG. 10A.

As illustrated in FIGS. 9, 10A, and 10B, at the start of provisional lock release of the provisional lock arm portion 36 of the lever 30, the provisional set arm portion 26 of the female housing 20 is being displaced, the provisional locking protrusion 36*a* of the provisional lock arm portion 36 of the lever 30 starts to contact the slope 13*b* of the distal end 13*a* of the release rib portion 13 of the male housing 11, and the protrusion portion 26*a* of the provisional set arm portion 26 of the female housing 20 is in contact with the straight slope 14*b* near a rear slope 14*c* of the provisional set beak portion 14 of the male housing 11.

Figure 11:
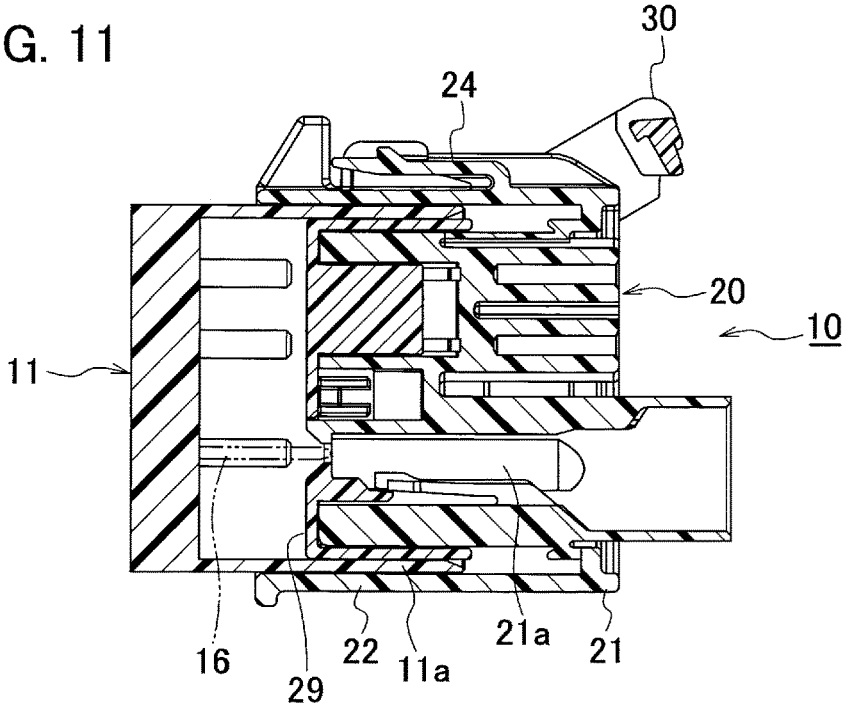
FIG. 11 is a cross-sectional view taken along line X-X in FIG. 4 during displacement of the provisional set arm portion while the provisional lock arm portion is being provisionally lock released.
Figure 12A:
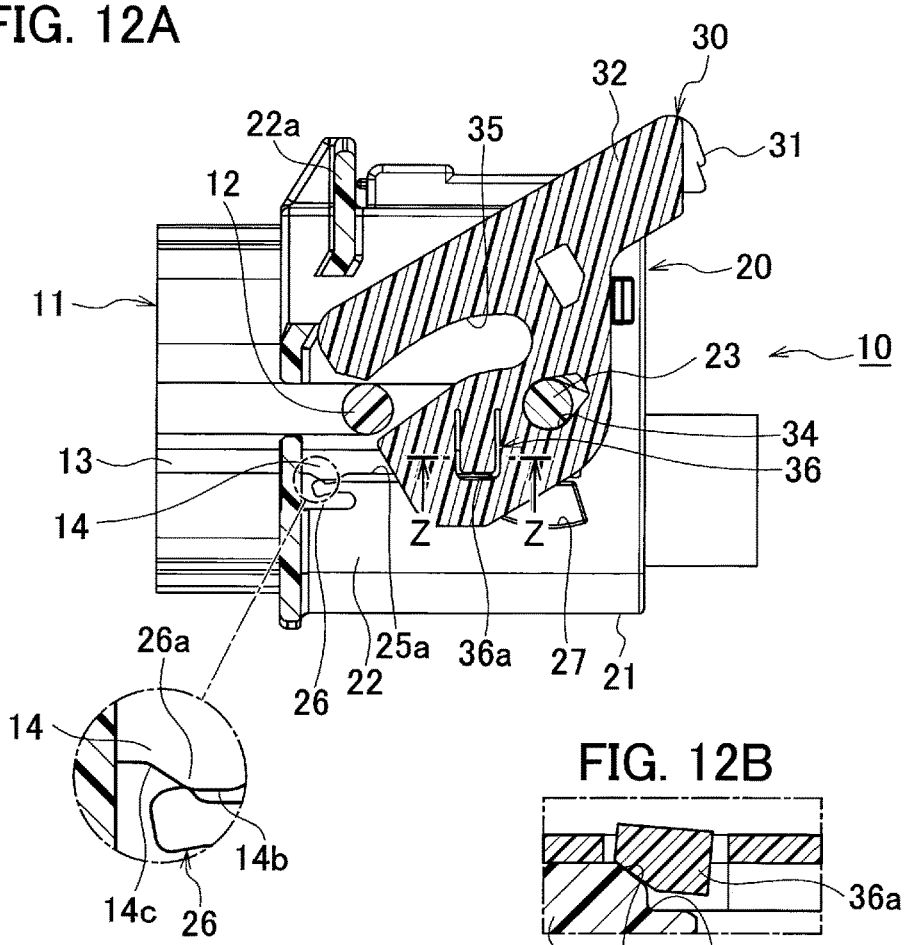
FIG. 12A is a cross-sectional view taken along line Y-Y in FIG. 4 during displacement of the provisional set arm portion while the provisional lock arm portion is being provisionally lock released.
Figure 12B:
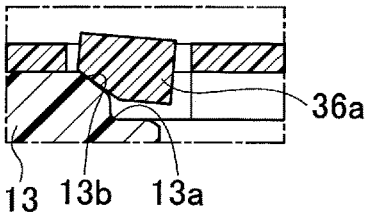
FIG. 12B is a cross-sectional view taken along line Z-Z in FIG. 12A.

As illustrated in FIGS. 11, 12A, and 12B, while the provisional lock arm portion 36 of the lever 30 is being provisionally lock released and the provisional set arm portion 26 of the female housing 20 is being displaced, the provisional locking protrusion 36*a* of the provisional lock arm portion 36 of the lever 30 continues to be in contact with the slope 13*b* of the distal end 13*a* of the release rib portion 13 of the male housing 11, and the protrusion portion 26*a* of the provisional set arm portion 26 of the female housing 20 comes near the rear slope 14*c* of the provisional set beak portion 14 of the male housing 11.

Figure 13:
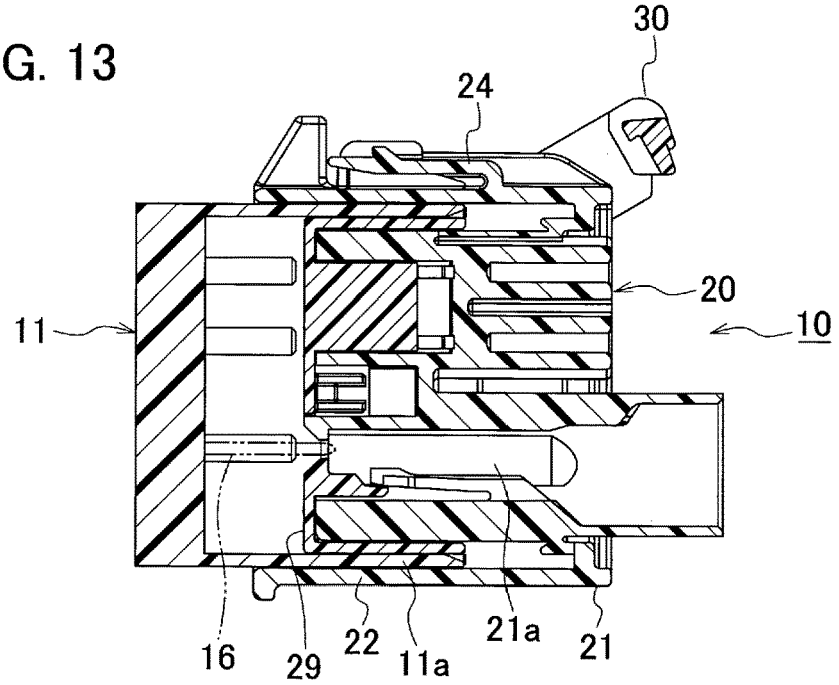
FIG. 13 is a cross-sectional view taken along line X-X in FIG. 4 at the time of displacement completion of the provisional set arm portion while the provisional lock arm portion is being provisionally lock released.

As illustrated in FIGS. 13, 14A, and 14B, at the peak of the provisional lock release of the provisional lock arm portion 36 of the lever 30, the displacement of the provisional set arm portion 26 of the female housing 20 is finished, the provisional locking protrusion 36*a* of the provisional lock arm portion 36 of the lever 30 comes into contact with the end of the slope 13*b* of the distal end 13*a* of the release rib portion 13 of the male housing 11, and the protrusion portion 26*a* of the provisional set arm portion 26 of the female housing 20 comes into contact with the end of the rear slope 14*c* of the provisional set beak portion 14 of the male housing 11, and returns to the original position. Thereby, the lever 30 can be turned.

Figure 15:
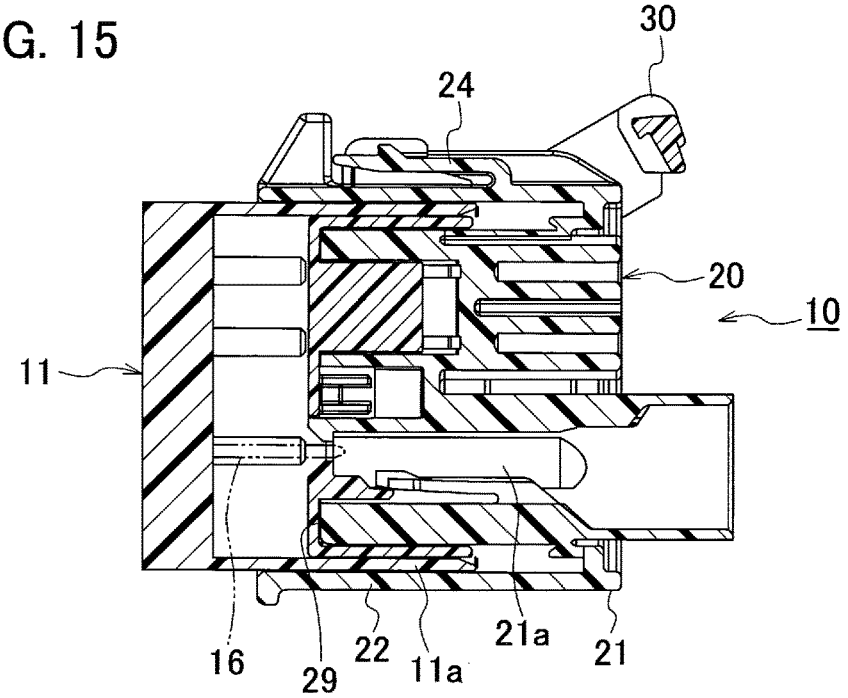
FIG. 15 is a cross-sectional view taken along line X-X in FIG. 4 when the provisional lock arm portion has been provisionally lock released.

As illustrated in FIG. 15, 16A, and 16B, when the provisional lock release of the provisional lock arm portion 36 of the lever 30 is completed, the provisional locking state between the provisional locking protrusion 36*a* of the provisional lock arm portion 36 of the lever 30 and the lower edge 25*a* of the cutout portion 25 of the female housing 20 is released at the distal end 13*a* of the release rib portion 13 of the male housing 11, and the protrusion portion 26*a* of the provisional set arm portion 26 of the female housing 20 goes over the rear slope 14*c* of the provisional set beak portion 14 of the male housing 11 and is in contact with the lower face 13*c* of the release rib portion 13.

According to the lever-type connector 10 of the above embodiment, during a provisional lock release between the provisional locking protrusion 36*a* of the provisional lock arm portion 36 of the lever 30 and the lower edge 25*a* of the cutout portion 25 of the female housing 20, the provisional set arm portion 26 that suppresses detachment between the male housing 11 and the female housing 20 in the provisionally set state is provided on each of both sides of the hood portion 22 of the female housing 20, and the male housing 11 and the female housing 20 in the provisionally set state are held by the reaction force due to the elastic deformation of the provisional set arm portion 26. As a result, it is possible to reliably suppress detachment between the male housing 11 and the female housing 20 in the provisionally set state before the lever 30 is turned, and it is possible to hold the provisionally set state of the male housing 11 and the female housing 20 before turning the lever 30. Also, by shifting the displacement timing of the provisional set arm portion 26 of the female housing 20 and the release timing of the provisional lock arm portion 36 of the lever 30, the provisional set force of the lever-type connector 10 can be reduced.

As illustrated in FIGS. 15, 16A, and 16B, after releasing the provisional locking between the provisional locking protrusion 36*a* of the provisional lock arm portion 36 of the lever 30 and the lower edge 25*a* of the cutout portion 25 of the female housing 20, the holding force of the lever-type connector 10 can be improved by the protrusion portion 26*a* of the provisional set arm portion 26 of the female housing 20 going over the provisional set beak portion 14 provided on the lower face 13*c* of the release rib portion 13 of the male housing 11.

According to the embodiment, although the cutout portion as the provisional locked portion of the female housing and the provisional locking protrusion as the provisional locking portion of the provisional lock arm portion of the lever are provisionally locked, the provisional locked portion may be a recess portion or a projection portion instead of the cutout portion.

What is claimed is:

1. A lever-type connector comprising:

a first housing having a cam boss;

a second housing fitted to and removed from the first housing; and a lever turnably supported by the second housing via a support shaft, the lever having a cam groove engaging with the cam boss, the lever configured to pull the first housing toward the second housing to fit the first housing and the second housing by engagement between the cam groove and the cam boss through a turning operation from a provisional locking position to a fitting completion position, wherein the lever includes a provisional lock arm portion having a provisional locking portion, the provisional lock arm portion being elastically deformed, the second housing includes a provisional locked portion configured to be provisionally locked to and detached from the provisional locking portion of the provisional lock arm portion and a provisional set arm portion configured to suppress detachment between the first housing and the second housing in a provisionally set state during a provisional lock release between the provisional locking portion of the provisional lock arm portion and the provisional locked portion of the second housing, and the first housing includes a release rib portion configured to release a provisional locking state between the provisional locking portion of the provisional lock arm portion and the provisional locked portion of the second housing.

2. The lever-type connector according to claim 1, wherein a provisional set beak portion is provided on a lower face of the release rib portion, a protrusion portion configured to slide along the lower face of the release rib portion is provided at a distal end of the provisional set arm portion, and a provisional locking state of the lever is released at a position where the protrusion portion goes over the provisional set beak portion from the lower face of the release rib portion.

3. The lever-type connector according to claim 2, wherein the provisional set beak portion has a trapezoidal shape, and is projected integrally with the release rib portion.

4. The lever-type connector according to claim 2, wherein a distal end of the release rib portion functions as a release portion to release a provisional locking state between the provisional locked portion of the second housing and the provisional lock arm portion of the lever.

* * * * *